US010607583B1

(12) United States Patent
Chen

(10) Patent No.: US 10,607,583 B1
(45) Date of Patent: Mar. 31, 2020

(54) DRUM WITH LUG MECHANISM TO PREVENT LOOSENING

(71) Applicant: K.H.S. Musical Instrument Co., Ltd., New Taipei (TW)

(72) Inventor: Bo-Ting Chen, New Taipei (TW)

(73) Assignee: K.H.S. Musical Instrument Co., Ltd., New Taipei (TW)

( * ) Notice: Subject to any disclaimer, the term of this patent is extended or adjusted under 35 U.S.C. 154(b) by 0 days.

(21) Appl. No.: 16/243,307

(22) Filed: Jan. 9, 2019

(30) Foreign Application Priority Data

Sep. 28, 2018 (TW) ..... 107134320 A

(51) Int. Cl.
*G10D 13/02* (2006.01)

(52) U.S. Cl.
CPC ..... *G10D 13/023* (2013.01); *G10D 13/027* (2013.01); *G10D 13/028* (2013.01)

(58) Field of Classification Search
CPC ... G10D 13/023; G10D 13/027; G10D 13/028
See application file for complete search history.

(56) References Cited

U.S. PATENT DOCUMENTS 3,139,783 A * 7/1964 Grant ..... G10D 13/02 84/411 R
3,865,003 A * 2/1975 Della-Porta ..... G10D 13/02 84/411 R
7,501,567 B1 * 3/2009 Spinazzola ..... G10D 13/023 84/411 R
8,629,340 B1 * 1/2014 Martin ..... G10D 13/023 84/411 R
8,642,867 B1 * 2/2014 Bedson ..... G10D 13/023 84/413
9,293,122 B1 * 3/2016 Martin ..... G10D 13/026
9,373,310 B2 * 6/2016 Martin ..... G10D 13/023
9,934,764 B2 * 4/2018 Jones ..... G10D 13/00
2005/0056137 A1 * 3/2005 DiPietro ..... G10D 13/00 84/411 R
2011/0030531 A1 * 2/2011 Nakata ..... G10D 13/026 84/421
2014/0165819 A1 * 6/2014 McGee ..... G10D 13/023 84/458
2015/0059553 A1 * 3/2015 Martin ..... G10D 13/023 84/413
2015/0161974 A1 * 6/2015 Martin ..... G10D 13/023 84/413
2016/0314770 A1 * 10/2016 Martin ..... G10D 13/023
2017/0040006 A1 * 2/2017 Martin ..... G10D 13/026
2017/0330535 A1 * 11/2017 Albright ..... G10D 13/023
2018/0261195 A1 * 9/2018 Allen ..... G10D 13/026

* cited by examiner

*Primary Examiner* — David S Warren
*Assistant Examiner* — Christina M Schreiber
(74) *Attorney, Agent, or Firm* — Huffman Law Group, PC

(57) ABSTRACT

The present invention provides a drum with a lug mechanism, which can adjust the tension of a drumhead mounted on the drum. The lug mechanism can also prevent loosening of a tension-adjusting member of the lug mechanism and enhance resonance of the drum.

10 Claims, 8 Drawing Sheets

DRUM WITH LUG MECHANISM TO PREVENT LOOSENING

CROSS-REFERENCE TO RELATED APPLICATIONS

The entire contents of Taiwan Patent Application No. 107134320, filed on Sep. 28 2018, from which this application claims priority, are expressly incorporated herein by reference.

BACKGROUND OF THE INVENTION

1. Field of the Invention

The present invention relates to a drum having a lug mechanism for adjusting the drumhead tension, and more particularly to a drum having a lug mechanism capable of preventing loosening and enhancing resonance.

2. Description of Related Art

Percussion instruments can be classified into two broad categories: idiophones and membranophones. In an idiophone, the vibrating element is the body of the instrument itself. In a membranophone, the vibrating element is a membrane or skin.

Drums generally belong to a membranophone. U.S. Pat. No. 9,373,310 describes the structure of a conventional drum. In the prior art, a common drum is composed of a pair of drum hoops or rims, a drum shell, a set of lugs, and a corresponding set of lug holders attached across the side of the drum shell.

The interior of each hoop contains a drumhead. The drumhead is the contact surface that vibrates when stricken during play. For a typical drum, the drumhead on the top side of the drum, sometimes called the batter head, is the part of the drum that a drummer strikes when playing the instrument. The drumhead on the bottom side of the drum provides resonance and is usually thinner than the drumhead on the top side.

Tuning assemblies on the drum hoop can be used to adjust the tension on the drumhead, thereby tuning the drumhead sound and also allowing different drumheads to be coupled to the shell mount. The drum hoop also contains various openings through which the set of lugs can pass through to connect to the corresponding set of lug holders that are attached across the side of the drum shell.

The shell is the body of the drum. It creates much of the sound characteristics of the drum based in part on the resonance of the materials from which the drum shell is constructed. When the drumhead is impacted, the drumhead vibrates. When the drum hoop is tightly coupled to the drum shell using the lug fastening system, the vibrations channel from the drumhead to the containing hoop and are dispersed across the shell. These vibrations then cause the drum shell to resonate which, in turn, produces some of the drum's sound characteristics. Often, the drum shell includes a small hole referred to as the vent hole. The vent hole allows air to escape when the drum is struck, which in turn improves the resonance of the drum.

In a conventional drum design, a lug is placed in a lug holder and screwed to couple the drum hoop to the drum shell. However, after long term percussion, the lug may be loosened from the lug holder, resulting in insufficient tension of the drumhead and causing the drumhead sound detuning.

In addition, in conventional drum structure and design the density of the drum shell material and thickness of the drum shell are needed to prevent the drum shell from warping or breaking when absorbing and counteracting the forces imposed by the tensioning of the lugs from the drum hoop to the lug holders attached along the side of the drum shell. This results in a lot of force on the drum shell. It is for this reason that some shells are manufactured with a thickness of up to 20 millimeters. In these instances, more energy is needed to induce resonance from such shells.

SUMMARY OF THE INVENTION

In one general aspect, the present invention relates to a drum having a lug mechanism for adjusting the drumhead tension, and more particularly to a drum having a lug mechanism capable of preventing loosening and enhancing resonance.

According to one embodiment of this invention, a drum is provided with a drum shell, a drumhead, a drum hoop, and a lug mechanism. The drumhead seals an opening of the drum shell. The drum hoop is used for holding the drumhead on the drum shell. The lug mechanism is used for coupling with the drum hoop to adjust a tension of the drumhead, comprising a threaded tension-adjusting member, a lug holder, and a tightening block. The lug holder is fixed to an outer periphery surface of the drum shell and comprises a tubular structure. The tubular structure comprises a through hole and a notch. The notch communicates with the through hole, and the through hole has an internal thread. A portion of the tightening block passes through the notch and is placed in the through hole to occupy a portion of a cross sectional area of the through hole. The tension-adjusting member is screwed into the through hole, and the thread of the tension-adjusting member engages with the internal thread of the through hole and passes through the portion of the tightening block that is placed in the through hole.

In one embodiment, the tightening block is made of a polymer.

In one embodiment, the lug holder further comprises a first pedestal and a second pedestal. The first pedestal comprises a first connecting end, a tubular structure through hole, and a first screw hole. The first connecting end is used for connecting the drum shell. The tubular structure through hole is vertically disposed away from the first connection end for receiving a first end of the tubular structure. The first screw hole is laterally disposed and extends from the first connecting end to the tubular structure through hole and communicates with the tubular structure through hole. The second pedestal comprises a second connecting end, a tubular structure receiving hole, and a second screw hole. The second connecting end is used for connecting the drum shell. The tubular structure receiving hole is vertically disposed away from the second connecting end for receiving a second end of the tubular structure. The second screw hole is laterally disposed and extends from the second connecting end to the tubular structure receiving hole and communicates with the tubular structure receiving hole.

In one embodiment, the first pedestal further comprises a recess communicating with the tubular structure through hole, a portion of the tightening block passes through the notch and is placed in the through hole, and the remaining portion of the tightening block is placed in the recess.

In one embodiment, the first pedestal further comprises a first fixing member, and the second pedestal further comprises a second fixing member. The first fixing member is used for fixing the first pedestal and the tubular structure, and the second fixing member is used for fixing the second pedestal and the tubular structure.

In one embodiment, both the first fixing member and the second fixing member are flat screws, an outer surface of a wall of the tubular structure includes a first flat surface and a second flat surface. The first fixing member is disposed in the first screw hole and has a flat head against the first flat surface. The second fixing member is disposed in the second screw hole and has a flat head against the second flat surface.

In one embodiment, the lug mechanism further comprises a coupling mechanism for coupling the tension-adjusting member and the drum shell, and the coupling mechanism comprises a lower seat and an upper seat. The lower seat comprises two lower hooks for hooking the drum hoop and a connecting tube located between the two lower hooks. The upper seat comprises two upper hooks, an upper opening, and a lower opening. The two upper hooks correspond to the two lower hooks, and each upper hook is disposed on one corresponding lower hook. The connecting tube is disposed between the upper opening and the lower opening, and the tension-adjusting member passes through the upper opening, the connecting tube, and the lower opening, and then is screwed into the through hole of the lug holder.

In one embodiment, the drum hoop includes an opening, and the tension-adjusting member passes through the opening and is then screwed into the through hole of the lug holder.

According to the lug mechanism provided by the embodiments of the present invention, the tension adjusting-member can be tightly coupled with the lug holder without being loosened from the lug holder. In addition, the lug holder features in reduced weight and reduced contact area between the lug holder and the drum shell without exerting a lot of force on the drum shell, thereby maximizing the resonance of the drum cavity.

DETAILED DESCRIPTION OF THE PREFERRED EMBODIMENT

Figure 1:
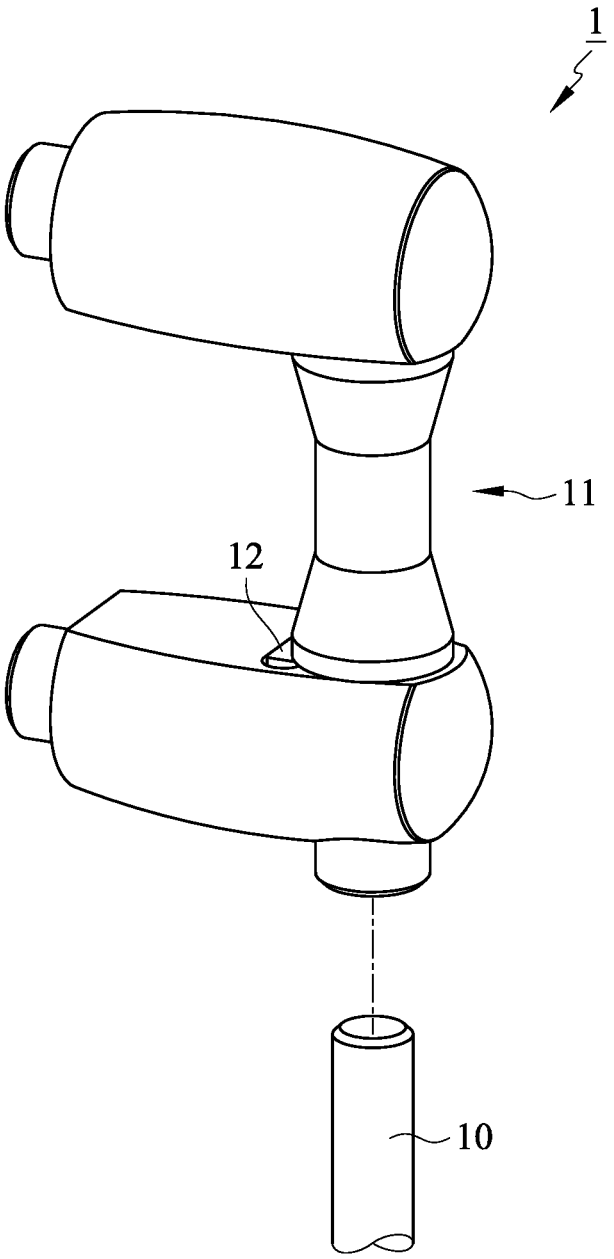
FIG. 1 is a perspective view showing a lug mechanism for preventing loosening in accordance with a preferred embodiment of the present invention.

Embodiments of the invention are now described and illustrated in the accompanying drawings, instances of which are to be interpreted to be to scale in some implementations while in other implementations, for each instance, not. In certain aspects, use of like or the same reference designators in the drawings and description refers to the same, similar or analogous components and/or elements, while according to other implementations the same use should not. According to certain implementations, use of directional terms, such as, top, bottom, left, right, up, down, over, above, below, beneath, rear, front, clockwise, and counterclockwise, are to be construed literally, while in other implementations the same use should not. While the invention will be described in conjunction with these specific embodiments, it will be understood that it is not intended to limit the invention to these embodiments. On the contrary, it is intended to cover alternatives, modifications, and equivalents as may be included within the spirit and scope of the invention as defined by the appended claims. In the following description, numerous specific details are set forth in order to provide a thorough understanding of the present invention. The present invention may be practiced without some or all of these specific details. In other instances, well-known process operations and components are not described in detail in order not to unnecessarily obscure the present invention. While drawings are illustrated in detail, it is appreciated that the quantity of the disclosed components may be greater or less than that disclosed, except where expressly restricting the amount of the components.

Figure 2:
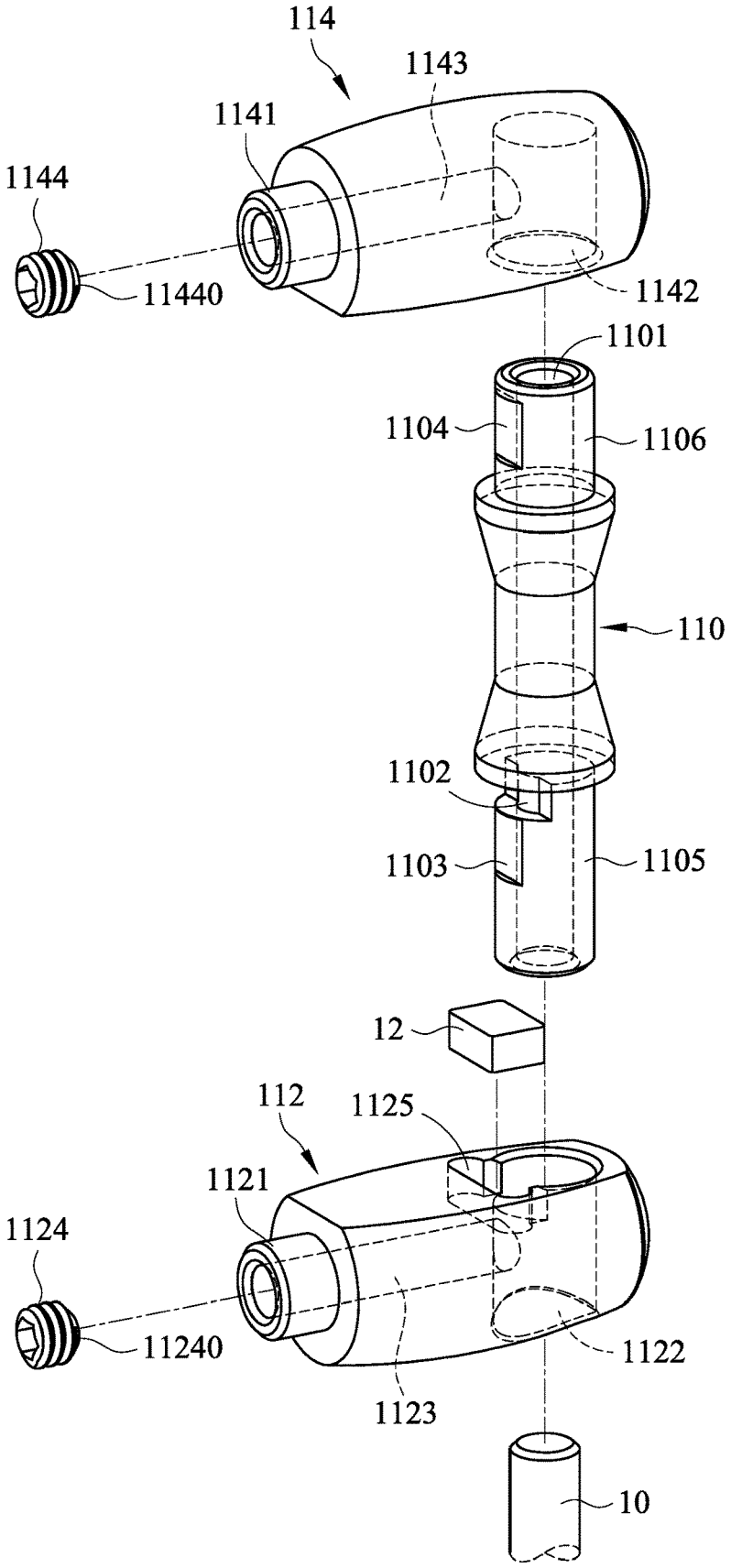
FIG. 2 is an exploded view showing the lug mechanism for preventing loosening in accordance with the preferred embodiment of the present invention.
Figure 3:
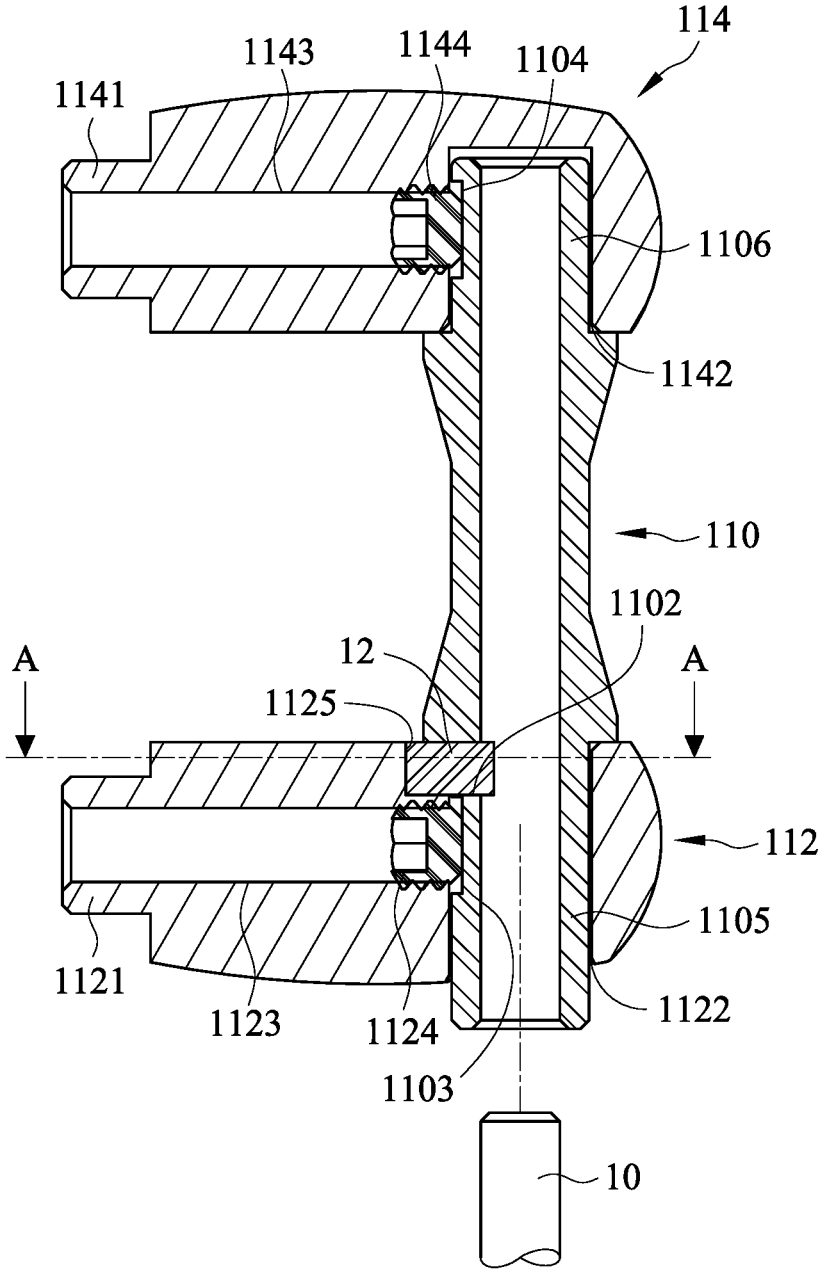
FIG. 3 is a cross-sectional view showing the lug mechanism for preventing loosening in accordance with the preferred embodiment of the present invention.
Figure 4:
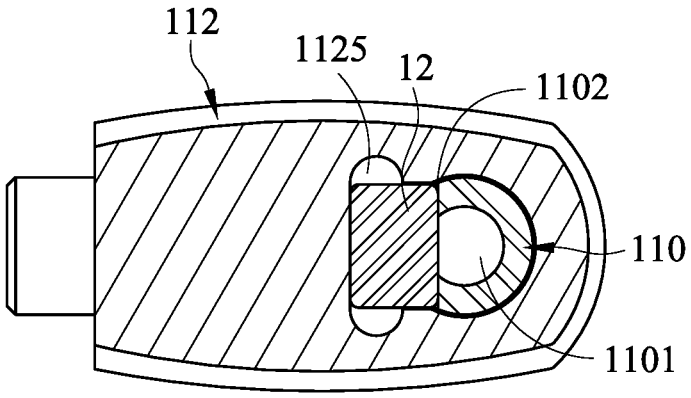
FIG. 4 is a cross-sectional view taken along line A-A of FIG. 3.

FIG. 1 is a perspective view showing a lug mechanism 1 for preventing loosening in accordance with a preferred embodiment of the present invention. FIG. 2 is an exploded view of the lug mechanism 1 in accordance with the preferred embodiment of the present invention. FIG. 3 is a cross-sectional view of the lug mechanism 1 in accordance with the preferred embodiment of the present invention. FIG. 4 is a cross-sectional view taken along line A-A of FIG. 3. Referring to FIGS. 1-4, the lug mechanism 1 mainly includes a tension-adjusting member 10, a lug holder 11, and a tightening block 12. The lug mechanism 1 is adapted for a drum (not shown, or exemplarily illustrated in FIGS. 5, 7, 8) having at least one drum hoop, at least one drumhead, and a shell. The drumhead seals an opening of the shell, and the drum hoop retains the drumhead on the shell. The lug holder 11 is fixed to the outer periphery surface of the shell.

Referring to FIGS. 1-4, the lug holder 11 mainly includes a tubular structure 110. The tubular structure 110 includes a through hole 1101 disposed in its axial direction, and the through hole 1101 is internally threaded (not shown). In another embodiment of the invention, a tapped hole that does not extend through the tubular structure 110 replaces the through hole 1101. A wall of the tubular structure 110 further includes a notch 1102 communicating with and exposing the through hole 1101. The tightening block 12 is disposed within the lug holder 11. A portion of the tightening block 12 passes through the notch 1102 and is placed within the through hole 1101 such that the tightening block 12 occupies a predetermined portion of the circular cross sectional area of the through hole 1101.

Referring to FIGS. 1-4, in some embodiments, the tightening block 12 occupies a portion, between ⅙ and ½, of the circular cross sectional area of the through hole 1101. However, the occupied ratio may be increased or decreased depending on the material or the needed tightness degree of the tightening block 12. In the present embodiment, the tightening block 12 is a rectangular block. However, in other embodiments, the tightening block 12 may have a different shape as long as the same tightening function can be achieved.

Referring to FIGS. 1-4, preferably, the tightening block 12 is made of a polymer or an engineering plastic. In the present embodiment, the tightening block 12 is made of high density polyethylene (HDPE). In an embodiment, the tightening block 12 is made of rubber. In other embodiments, the tightening block 12 may be made of other materials as long as the same function can be achieved.

Referring to FIGS. 1-4, the tension-adjusting member 10 is threaded (the thread is not shown). By rotating the tension-adjusting member 10, the thread of the tension-adjusting member 10 is engaged with the thread of the through hole 1101, and the tension-adjusting member 10 can be moved up and down within the through hole 1101. Since the tightening block 12 occupies a portion of the circular cross-sectional area of the through hole 1101, the friction between the tightening block 12 and the tension-adjusting member 10 will cause the tension-adjusting member 10 to be firmly locked within the tubular structure 110 as the tension-adjusting member 10 is rotated through the tightening block 12.

Referring to FIGS. 1 to 4, the lug holder 11 may further include a first pedestal 112 and a second pedestal 114. The lug holder 11 is connected to the drum shell through the first pedestal 112 and the second pedestal 114.

As shown in FIGS. 1-4, the first pedestal 112 includes a first connecting end 1121, a tubular structure through hole 1122, and a first screw hole 1123. The first connecting end 1121 is connected to the drum shell. The tubular structure through hole 1122 is vertically disposed away from the first connection end 1121. The first screw hole 1123 is laterally disposed and extends from the first connection end 1121 to the tubular structure through hole 1122 and communicates with the tubular structure through hole 1122.

As shown in FIGS. 1-4, the second pedestal 114 includes a second connecting end 1141, a tubular structure receiving hole 1142, and a second screw hole 1143. The second connecting end 1141 is connected to the drum shell. The tubular structure receiving hole 1142 is longitudinally vertically disposed away from the second connecting end 1141. The second screw hole 1143 is laterally disposed and extends from the second connecting end 1141 to the tubular structure receiving hole 1142 and communicates with the tubular structure receiving hole 1142.

Referring to FIGS. 1-4, the first pedestal 112 further includes a first fixing member 1124, and the second pedestal 114 further includes a second fixing member 1144. The first fixing member 1124 is used for fixing the first pedestal 112 and the tubular structure 110, and the second fixing member 1144 is used for fixing the second pedestal 114 and the tubular structure 110. In the present embodiment, the first fixing member 1124 and the second fixing member 1144 comprises, but are not limited to, flat screws. The first end 1105 of the tubular structure 110 is placed into the tubular structure through hole 1122 of the first pedestal 112, and the second end 1106 of the tubular structure 110 is placed into the tubular structure receiving hole 1142 of the second pedestal 114. The first fixing member 1124 is rotated until its flat head 11240 is against the first flat surface 1103 on the outer surface of wall of the tubular structure 110. The second fastener fixing member is rotated until its flat head 11440 is against the second flat surface 1104 on the outer surface of wall of the tubular structure 110. Thereby, the tubular structure 110 is fixed to the first pedestal 112 and the second pedestal 114.

Referring to FIGS. 1-4, the first pedestal 112 also includes a recess 1125 that communicates with the tubular structure through holes 1122. A portion of the tightening block 12 is placed in the recess 1125, and the remaining portion of the tightening block 12 passes through the notch 1102 and is placed in the through hole 1101.

Referring to FIGS. 1-4, the lug mechanism 1 may further include a first fastening member (not shown) and a second fastening member (not shown) to fix the lug holder 11 and the drum shell. The first fastening member and the second fastening member may include, but are not limited to, screws. The two screws respectively pass through the corresponding openings of the drum shell, and are screwed into the first screw hole 1123 of the first pedestal 112 and the second screw hole 1143 of the second pedestal 114.

As shown in FIGS. 1-4, preferably, the lug holder 11 has a substantially I-shaped configuration, and the first connecting end 1121 and the second connecting end 1141, arranged at the same side of the I-shaped structure, are fixed to outer periphery surface of the drum shell. In addition, preferably, two gaskets 115 (FIGS. 5 and 7) are provided between the outer surface of the drum shell and the first connecting end 1121 and between the outer surface of the drum shell and the second connecting end 1141. The gasket 115 is preferably made of rubber. The gasket 115 not only protects the drum shell, but also enhances the transmission of the tone.

Figure 5:
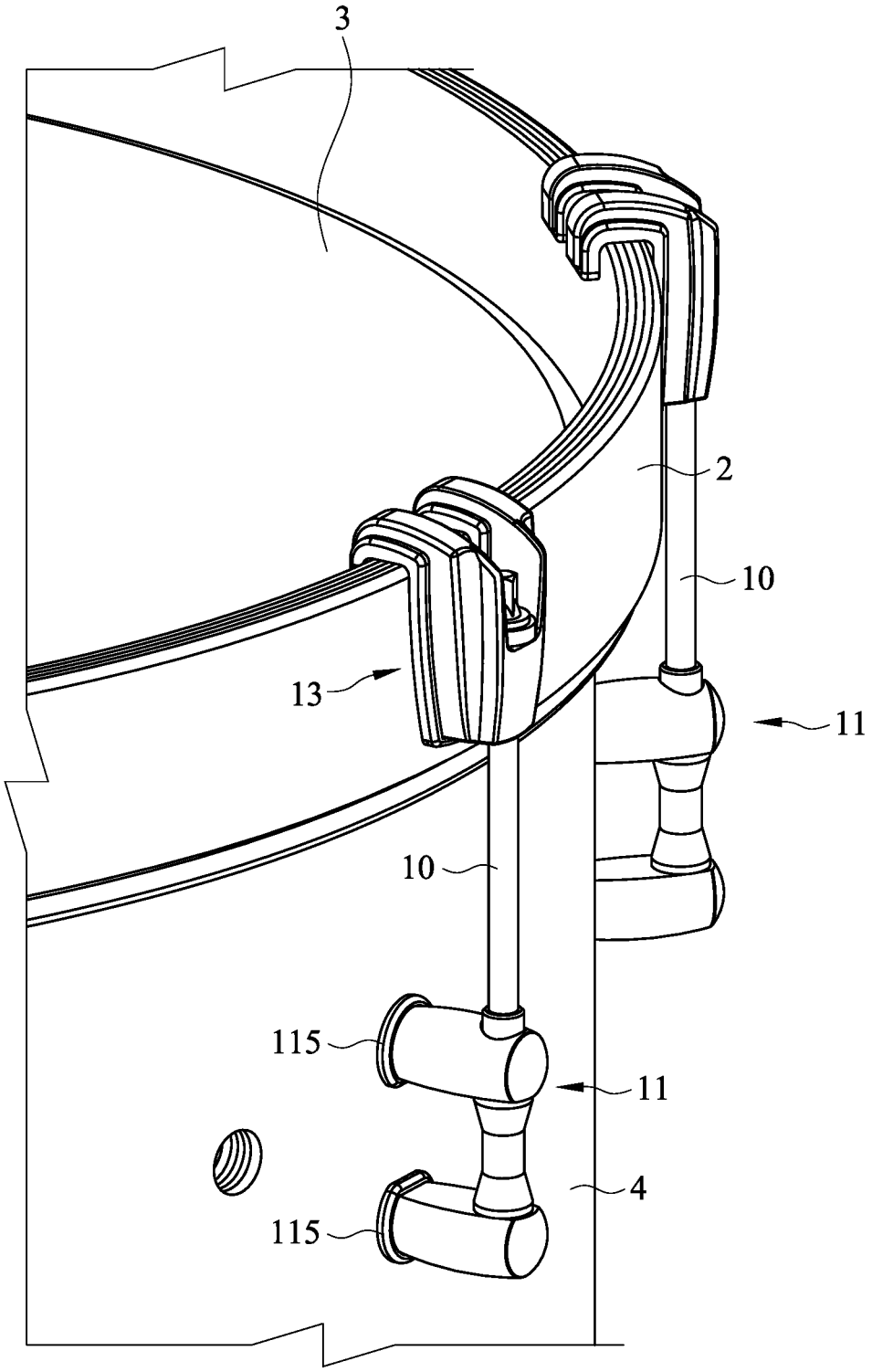
FIG. 5 is a partially perspective view of a drum provided in accordance with an embodiment of the present invention.

FIG. 5 is a partially perspective view of a drum provided by an embodiment of the present invention. As shown in FIG. 4, the drum at least includes a plurality of lug mechanisms 1, a drum hoop 2, a drumhead 3, and a drum shell 4. The drumhead 3 seals the opening of the drum shell 4, and the drum hoop 2 is used to retain the drumhead 3 on the drum shell 4. As described before, the lug mechanism 1 mainly includes a tension-adjusting member 10, a lug holder 11, and a tightening block 12 (FIGS. 2-3). The lug holder 11 is fixed to the outer periphery surface of the drum shell 4. Further, in the present embodiment, the lug mechanism 1 further includes a coupling mechanism 13 for connecting the tension-adjusting member 10 and the drum hoop 2.

Figure 6:
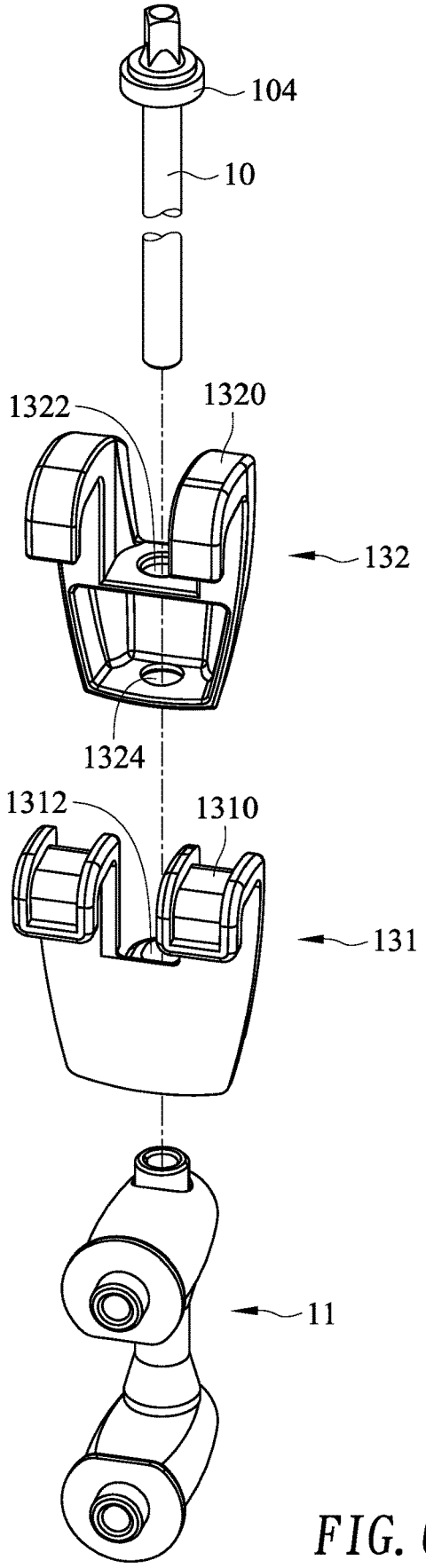
FIG. 6 is a schematic view of the lug mechanism of FIG. 5.

FIG. 6 is a schematic view of the lug mechanism 1 shown in FIG. 5. Referring to FIGS. 5 and 6, the coupling mechanism 13 includes a lower seat 131 and an upper seat 132. The lower seat 131 includes two lower hooks 1310 and a connecting tube 1312. The lower hook 1310 is for hooking the drum shell 2, and the connecting pipe 1312 is longitudinally disposed between the two lower hooks 1310. The upper seat 132 includes two upper hooks 1320, an upper opening 1322, and a lower opening 1324. The two upper hooks 1320 are respectively disposed on one corresponding lower hook 1310, and the upper opening 1322 and the lower opening 1324 are located between the two upper hooks 1320. The connecting tube 1312 is located between the upper opening 1322 and the lower opening 1324. The tension-adjusting member 10 passes through the upper opening 1322, the connecting tube 1312, and the lower opening 1324 and then is screwed into the lug holder 11. A spacing piece 104 may be provided between the head of the tension-adjusting member 10 and the upper opening 1322. Preferably, the spacing piece 104 is made of plastic.

Figure 7:
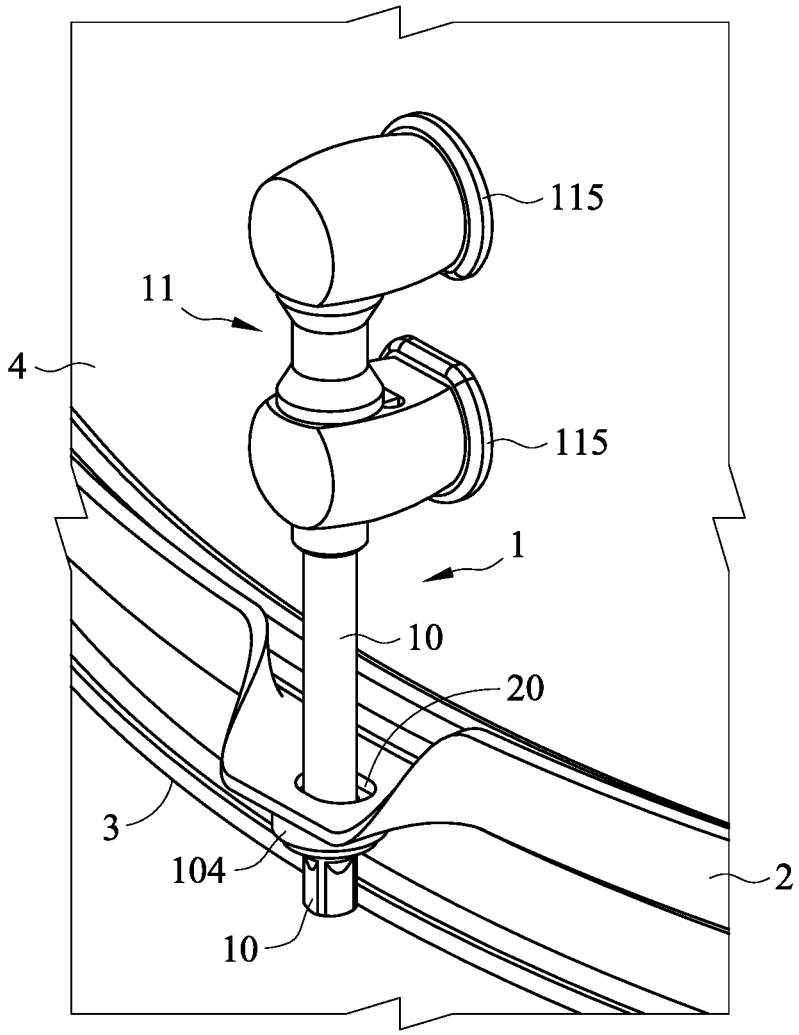
FIG. 7 is a partially perspective view of a drum provided in accordance with an embodiment of the present invention.

FIG. 7 is a partially perspective view of a drum provided by another embodiment of the present invention. As shown in FIG. 7, the drum at least includes a plurality of lug mechanisms 1, a drum hoop 2, a drumhead 3, and a drum shell 4. The drumhead 3 seals the opening of the drum shell 4, and the drum hoop 2 is used to retain the drumhead 3 on the drum shell 4. As described before, the lug mechanism 1 mainly includes a tension-adjusting member 10, a lug holder 11, and a tightening block 12 (FIGS. 2-3). The lug holder 11 is fixed to the outer periphery surface of the drum shell 4. Further, in the present embodiment, the drum hoop 2 includes a plurality of openings 20, and each drum hoop corresponds to one of the lug mechanisms 1. The number of the lug mechanism 1 can be determined according to the size of the drum. The tension-adjusting member 10 passes through the opening 20 and then is screwed into the lug holder 11. There may be a spacing piece 104 between the head of the tension-adjusting member 10 and the opening 20. Preferably, the spacing piece 104 is made of plastic.

Figure 8:
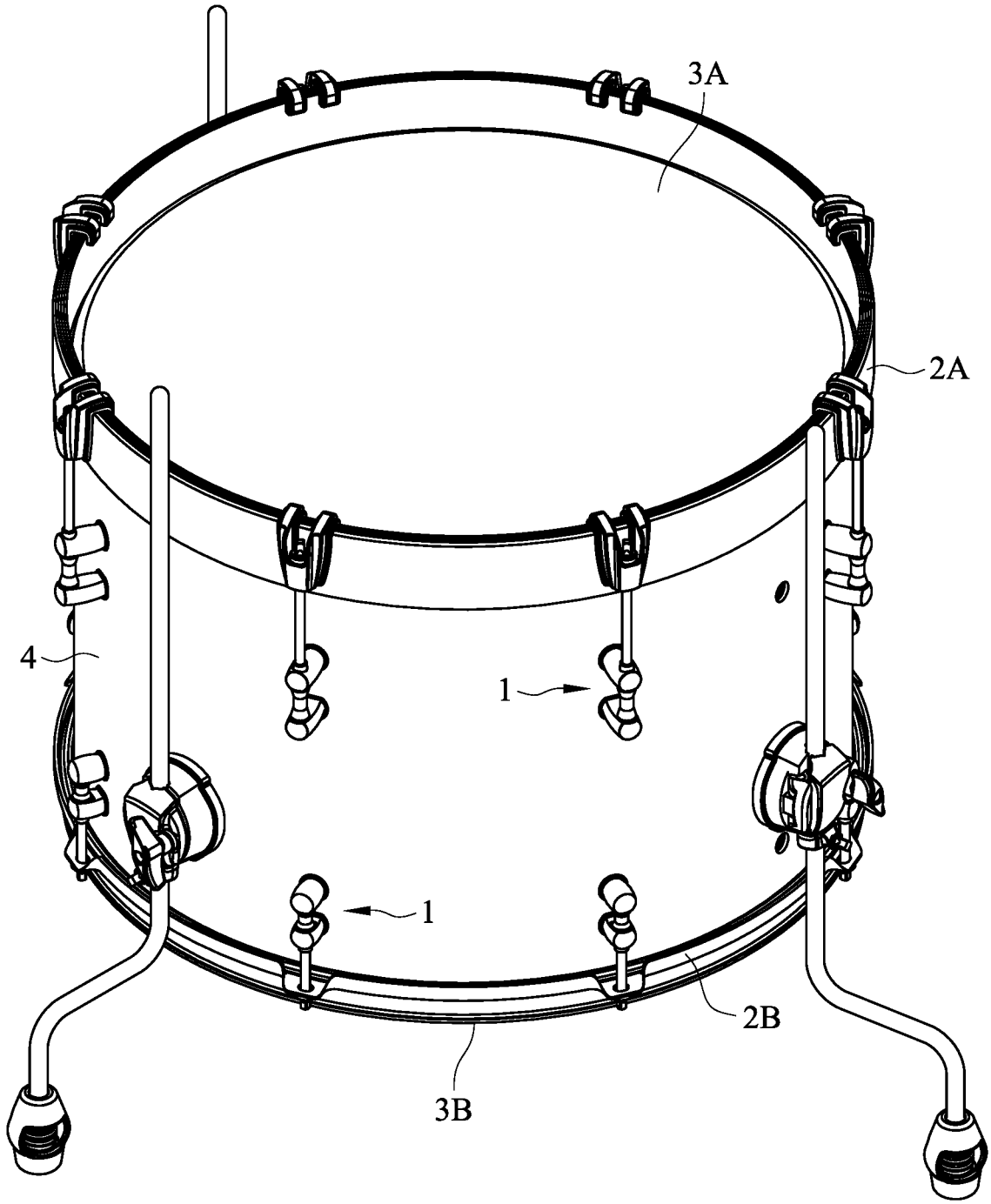
FIG. 8 is a perspective view of a drum provided in accordance with another embodiment of the present invention.

FIG. 8 is a perspective view of a drum provided by another embodiment of the present invention. As shown in FIG. 8, the drum mainly includes a first drumhead 3A, a first drum hoop 2A, a drum shell 4, a second drumhead 3B, a second drum hoop 2B, and a plurality of lug mechanisms 1. The first drumhead 3A seals the upper opening of the drum shell 4, and the first drum hoop 2A is used for holding the first drumhead 3A on the drum shell 4. The second drumhead 3B seals the lower opening of the drum shell 4, and the second drum hoop 2B is used for holding the second drum head 3B on the drum shell 4. Some of the lug mechanisms 1 couple to the first drum hoop 2A for adjusting the tension of the first drumhead 3A, and other lug mechanisms 1 couple to the second drum hoop 2B for adjusting the tension of the second drumhead 3B.

According to the lug mechanism provided by the embodiments of the present invention, the drummer can adjust the drumhead 3 to have an appropriate tension by rotating the tension-adjusting member 10. Further, by the tightening block 12, the tension adjusting-member 10 can be tightly coupled with the lug holder 11 without being loosened from the lug holder 11. In addition, the lug holder 11 can have an I-shaped configuration featuring in reduced contact area between the lug holder 11 and the drum shell 4 and reduced weight of the lug holder 11 without exerting a lot of force on the drum shell, and thereby maximizing the resonance of the drum cavity.

The intent accompanying this disclosure is to have each/all embodiments construed in conjunction with the knowledge of one skilled in the art to cover all modifications, variations, combinations, permutations, omissions, substitutions, alternatives, and equivalents of the embodiments, to the extent not mutually exclusive, as may fall within the spirit and scope of the invention. Corresponding or related structure and methods disclosed or referenced herein, and/or in any and all co-pending, abandoned or patented application(s) by any of the named inventor(s) or assignee(s) of this application and invention, are incorporated herein by reference in their entireties, wherein such incorporation includes corresponding or related structure (and modifications thereof) which may be, in whole or in part, (i) operable and/or constructed with, (ii) modified by one skilled in the art to be operable and/or constructed with, and/or (iii) implemented/made/used with or in combination with, any part(s) of the present invention according to this disclosure, that of the application and references cited therein, and the knowledge and judgment of one skilled in the art.

Conditional language, such as, among others, "can," "could," "might," or "may," unless specifically stated otherwise, or otherwise understood within the context as used, is generally intended to convey that embodiments include, and in other interpretations do not include, certain features, elements and/or steps. Thus, such conditional language is not generally intended to imply that features, elements and/or steps are in any way required for one or more embodiments, or interpretations thereof, or that one or more embodiments necessarily include logic for deciding, with or without user input or prompting, whether these features, elements and/or steps are included or are to be performed in any particular embodiment.

All of the contents of the preceding documents are incorporated herein by reference in their entireties. Although the disclosure herein refers to certain illustrated embodiments, it is to be understood that these embodiments have been presented by way of example rather than limitation. For example, any of the particulars or features set out or referenced herein, or other features, including method steps and techniques, may be used with any other structure(s) and process described or referenced herein, in whole or in part, in any combination or permutation as a non-equivalent, separate, non-interchangeable aspect of this invention. Corresponding or related structure and methods specifically contemplated and disclosed herein as part of this invention, to the extent not mutually inconsistent as will be apparent from the context, this specification, and the knowledge of one skilled in the art, including, modifications thereto, which may be, in whole or in part, (i) operable and/or constructed with, (ii) modified by one skilled in the art to be operable and/or constructed with, and/or (iii) implemented/made/used with or in combination with, any parts of the present invention according to this disclosure, include: (I) any one or more parts of the above disclosed or referenced structure and methods and/or (II) subject matter of any one or more of the inventive concepts set forth herein and parts thereof, in any permutation and/or combination, include the subject matter of any one or more of the mentioned features and aspects, in any permutation and/or combination.

Although specific embodiments have been illustrated and described, it will be appreciated by those skilled in the art that various modifications may be made without departing from the scope of the present invention, which is intended to be limited solely by the appended claims.

What is claimed is:

1. A drum, comprising:

a drum shell;

a drumhead that seals an opening of the drum shell;

a drum hoop for holding the drumhead on the drum shell;

a lug mechanism for coupling with the drum hoop to adjust a tension of the drumhead, comprising:

a tension-adjusting member having a thread;

a lug holder being fixed to an outer periphery surface of the drum shell and comprising a tubular structure, the tubular structure comprising a through hole and a notch, the notch communicating with the through hole, the through hole having an internal thread;

a tightening block, a portion of the tightening block passing through the notch and being placed in the through hole to occupy a portion of a cross sectional area of the through hole;

wherein the tension-adjusting member is screwed into the through hole, the thread of the tension-adjusting member engages with the internal thread of the through hole and passes through the portion of the tightening block that is placed in the through hole;

wherein the lug mechanism further comprises a coupling mechanism for coupling the tension-adjusting member and the drum shell, and the coupling mechanism comprises:

a lower seat, comprising:

two lower hooks for hooking the drum hoop;

a connecting tube located between the two lower hooks;

an upper seat, comprising:

two upper hooks corresponding to the two lower hooks, each of the two upper hooks is disposed on one corresponding lower hook;

an upper opening; and a lower opening; wherein the connecting tube is disposed between the upper opening and the lower opening, and the-tension adjusting member passes through the upper opening, the connecting tube, and the lower opening, and then is screwed into the through hole of the lug holder.

2. The drum as recited in claim 1, wherein the tightening block is made of a polymer.

3. The drum as recited in claim 1, wherein the lug holder further comprises:

a first pedestal, comprising:

a first connecting end for connecting the drum shell;

a tubular structure through hole being vertically disposed away from the first connection end for receiving a first end of the tubular structure; and a first screw hole being laterally disposed and extending from the first connecting end to the tubular structure through hole and communicating with the tubular structure through hole;

a second pedestal, comprising:

a second connecting end for connecting the drum shell;

a tubular structure receiving hole being vertically disposed away from the second connecting end for receiving a second end of the tubular structure; and a second screw hole being laterally disposed and extending from the second connecting end to the tubular structure receiving hole and communicating with the tubular structure receiving hole.

4. The drum as recited in claim 3, wherein the first pedestal further comprises a recess communicating with the tubular structure through hole, the portion of the tightening block passes through the notch and is placed in the through hole, and the remaining portion of the tightening block is placed in the recess.

5. The drum as recited in claim 3, wherein the first pedestal further comprises a first fixing member, and the second pedestal further comprises a second fixing member, and wherein the first fixing member is used for fixing the first pedestal and the tubular structure, and the second fixing member is used for fixing the second pedestal and the tubular structure.

6. The drum as recited in claim 5, wherein both the first fixing member and the second fixing member are flat screws, an outer surface of a wall of the tubular structure includes a first flat surface and a second flat surface, the first fixing member is disposed in the first screw hole and has a flat head against the first flat surface, the second fixing member is disposed in the second screw hole and has a flat head against the second flat surface.

7. The drum as recited in claim 3, further comprising a first gasket between the outer periphery surface of the drum shell and the first connecting end and a second gasket between the outer periphery surface of the drum shell and the second connecting end.

8. The drum as recited in claim 7, wherein the first gasket and the second gasket are made of rubber.

9. The drum as recited in claim 1, wherein the tension-adjusting member further comprises a spacing piece between its head and the upper opening.

10. The drum as recited in claim 1, wherein the drum hoop includes an opening, and the tension-adjusting member passes through the opening and is then screwed into the through hole of the lug holder.

* * * * *